US008695473B2

(12) United States Patent
Kametz et al.

(10) Patent No.: US 8,695,473 B2
(45) Date of Patent: Apr. 15, 2014

(54) OVEREXTRUSION OF SILICONE RUBBER CHARGE HOLDER ON METAL WIRE ROPE

(75) Inventors: David Kametz, Glastonbury, CT (US); Kevin Duprey, West Hartford, CT (US)

(73) Assignee: Ensign-Bickford Aerospace & Defense Company, Simsbury, CT (US)

( * ) Notice: Subject to any disclaimer, the term of this patent is extended or adjusted under 35 U.S.C. 154(b) by 8 days.

(21) Appl. No.: 13/413,698

(22) Filed: Mar. 7, 2012

(65) Prior Publication Data

US 2013/0233161 A1 Sep. 12, 2013

(51) Int. Cl.
*F42B 15/38* (2006.01)

(52) U.S. Cl.
USPC ..... 89/1.14; 102/378

(58) Field of Classification Search
USPC ..... 89/1.14, 1.57; 102/275.1, 275.8, 377, 102/378
See application file for complete search history.

(56) References Cited

U.S. PATENT DOCUMENTS

| | | | | |
|---|---|---|---|---|
| 2,877,708 | A * | 3/1959 | Marcel | 102/275.8 |
| 3,362,290 | A | 1/1968 | Carr et al. | |
| 3,486,410 | A * | 12/1969 | Lake et al. | 89/1.14 |
| 3,698,281 | A * | 10/1972 | Brandt et al. | 89/1.14 |
| 4,137,848 | A | 2/1979 | Cunha | |
| 4,685,376 | A | 8/1987 | Noel et al. | |
| 5,331,894 | A | 7/1994 | Wassell et al. | |
| 5,390,606 | A | 2/1995 | Harris | |
| 5,392,684 | A | 2/1995 | Renfro et al. | |
| 5,585,596 | A | 12/1996 | Richards et al. | |
| 5,780,763 | A * | 7/1998 | Schimmel et al. | 102/302 |
| 5,898,123 | A | 4/1999 | Fritz et al. | |
| 5,969,287 | A | 10/1999 | Blain et al. | |
| 5,983,802 | A | 11/1999 | Blain et al. | |
| 5,992,328 | A | 11/1999 | Blain et al. | |
| 6,125,762 | A | 10/2000 | Fritz et al. | |
| 6,298,786 | B1 * | 10/2001 | Grosskrueger et al. | 102/378 |
| 7,261,038 | B2 * | 8/2007 | Cleveland | 102/378 |
| 2012/0085222 | A1 * | 4/2012 | Travis | 89/1.14 |

* cited by examiner

*Primary Examiner* — Gabriel Klein
(74) *Attorney, Agent, or Firm* — Cantor Colburn LLP

(57) ABSTRACT

An elastomeric charge holder includes one or more holes formed therein into which is disposed an explosive charge. The elastomeric charge holder further includes one or more metal wires also disposed within the elastomeric charge holder. The elastomeric charge holder may be over molded or over extruded over each of the one or more metal wires, thereby retaining each of the one or more wires in place during use of the elastomeric charge holder. The one or more wires are also a better match of thermal coefficients to a metal confinement tube that holds the elastomeric charge holder, which results in improved retention of the elastomeric charge holder in place, particularly during initiation of the explosive charge.

18 Claims, 7 Drawing Sheets

OVEREXTRUSION OF SILICONE RUBBER CHARGE HOLDER ON METAL WIRE ROPE

FIELD OF THE INVENTION

The present invention relates in general to frangible separation joints utilized in flight vehicle structures, and in particular, to such a frangible separation joint having an expansion device located there within that contains an explosive charge (e.g. a mild detonating fuse) disposed within an elastomeric (e.g., silicone rubber) charge holder along with one or more metal wires also disposed within the charge holder, where the elastomeric charge holder is over molded or over extruded onto the metal wires for improved retention of the charge holder in its desired location through all of the various operating stages of the flight vehicle structure.

BACKGROUND OF THE INVENTION

Various types of flight vehicle structures such as rockets, missiles, satellites, and the like are typically configured in a plurality of stages. When in use, these vehicle flight structures oftentimes need to separate one stage from another on command at a specific time during vehicle flight and relatively instantaneously while having the separated stage drop off from the remainder of the flight vehicle structure and while also maintaining complete confinement of any explosive debris. One commonly used device for selectively separating one stage from another is a frangible separation joint.

Various types of flight vehicle structures such as rockets, missiles, satellites, cargo hold/payload, also contain fairing/body panels used to protect internal components that later need to be uncovered. When in use, these vehicle flight panels oftentimes need to separate from the vehicle and another on command at a specific time during vehicle flight and relatively instantaneously while having the separated panels drop off from the flight vehicle structure and while also maintaining complete confinement of any explosive debris. One commonly used device for selectively separating fairing/body panels from another is a frangible separation joint.

Such a frangible separation joint is commonly in the form of a ring or rail that is mechanically connected (e.g., bolted) to the two vehicle stages or fairing panels and located there between along the entire outer circumference of both stages. The separation joint typically contains an expansion device or confinement tube located within a receiving channel and commonly made from a metal such as aluminum or stainless steel. The expansion device contains an elastomeric material (e.g., silicone rubber) with at least one hole formed there through that contains an explosive charge, such as a mild detonating fuse that runs the entire length of the separation joint (i.e., a linear explosive charge).

The frangible joint also typically has an initiation manifold located at a point along its circumferential length. The initiation manifold typically contains one or more electrical wires that connect the explosive charge to a charge detonation control device (e.g., a flight vehicle computer). Upon the selective commanded detonation of the explosive charge at the appropriate time during vehicle flight, the shock from the explosion is transmitted to the expansion device or confinement tube which subsequently fractures a separation ring along a stress riser, rupture groove or fracture seam (e.g., one or more grooves). The fracture seam thus forms a line of separation between the two stages of the flight vehicle. Typically, complete confinement of the explosive by-products or debris is maintained by the confinement tube and associated explosive initiation manifold. Also, no secondary fracturing of the flight vehicle structures desirably occurs. Once the separation ring fractures upon detonation of the explosive material, complete separation of the two stages of the flight vehicle structure previously held together by the frangible joint has taken place such that one stage falls away from the remainder of the flight vehicle structure, which then continues on in its flight.

Problems with such a frangible separation joint include the fact that the silicone rubber charge holder tends to thermally contract and/or undergo acceleration compression or deformation during the various stages of flight of the flight vehicle structure. As a result, a less than desired amount of mechanical retention of the silicone rubber charge holder within the metal confinement tube occurs. That is, the silicone rubber charge holder tends to move and/or deform during vehicle flight. Also, a relatively large mismatch of the coefficients of thermal expansion occurs between the silicone rubber charge holder and the surrounding aluminum or stainless steel confinement tube. This causes a lack of control of the expansion and contraction between the silicone charge holder and the surrounding metal confinement tube during the various stages of flight of the flight vehicle structure.

What is needed is an improved frangible separation joint of the type mentioned herein above that eliminates the problems discussed herein above of such prior art frangible separation joints.

SUMMARY OF THE INVENTION

According to an embodiment of the invention, an elastomeric charge holder includes one or more holes formed therein into which is disposed an explosive charge. The elastomeric charge holder further includes one or more metal wires also disposed within the elastomeric charge holder. The elastomeric charge holder may be over molded or over extruded over each of the one or more metal wires, thereby retaining each of the one or more wires in place during use of the elastomeric charge holder. The one or more wires are also a better match of thermal coefficients to a metal confinement tube that holds the elastomeric charge holder, which results in improved retention of the elastomeric charge holder in place, particularly during initiation of the explosive charge.

Advantages of embodiments of the present invention include the fact that the afore mentioned problems with the prior art are reduced or otherwise eliminated altogether.

BRIEF DESCRIPTION OF THE DRAWINGS

The various embodiments of the present invention can be understood with reference to the following drawings. The components are not necessarily to scale. Also, in the drawings, like reference numerals designate corresponding parts throughout the several views.

FIG. 5, including

FIG. 6, including

FIG. 7, including FIG. 8, including

DETAILED DESCRIPTION OF THE INVENTION

The present invention is more particularly described in the following description and examples that are intended to be illustrative only since numerous modifications and variations therein will be apparent to those skilled in the art. As used in the specification and in the claims, the singular form "a," "an," and "the" may include plural referents unless the context clearly dictates otherwise. Also, as used in the specification and in the claims, the term "comprising" may include the embodiments "consisting of" and "consisting essentially of." Furthermore, all ranges disclosed herein are inclusive of the endpoints and are independently combinable.

As used herein, approximating language may be applied to modify any quantitative representation that may vary without resulting in a change in the basic function to which it is related. Accordingly, a value modified by a term or terms, such as "about" and "substantially," may not to be limited to the precise value specified, in some cases. In at least some instances, the approximating language may correspond to the precision of an instrument for measuring the value.

In embodiments of the present invention, an elastomeric charge holder includes one or more holes formed therein into which is disposed an explosive charge. The elastomeric charge holder further includes one or more metal wires also disposed within the elastomeric charge holder. The elastomeric charge holder may be over molded or over extruded over each of the one or more metal wires, thereby retaining each of the one or more wires in place during use of the elastomeric charge holder. The one or more wires are also a better match of thermal coefficients to a metal confinement tube that holds the elastomeric charge holder, which results in improved retention of the elastomeric charge holder in place, particularly during initiation of the explosive charge.

The foregoing and other features of various disclosed embodiments of the invention will be more readily apparent from the following detailed description and drawings of the illustrative embodiments of the invention wherein like reference numbers refer to similar elements.

Figure 1:
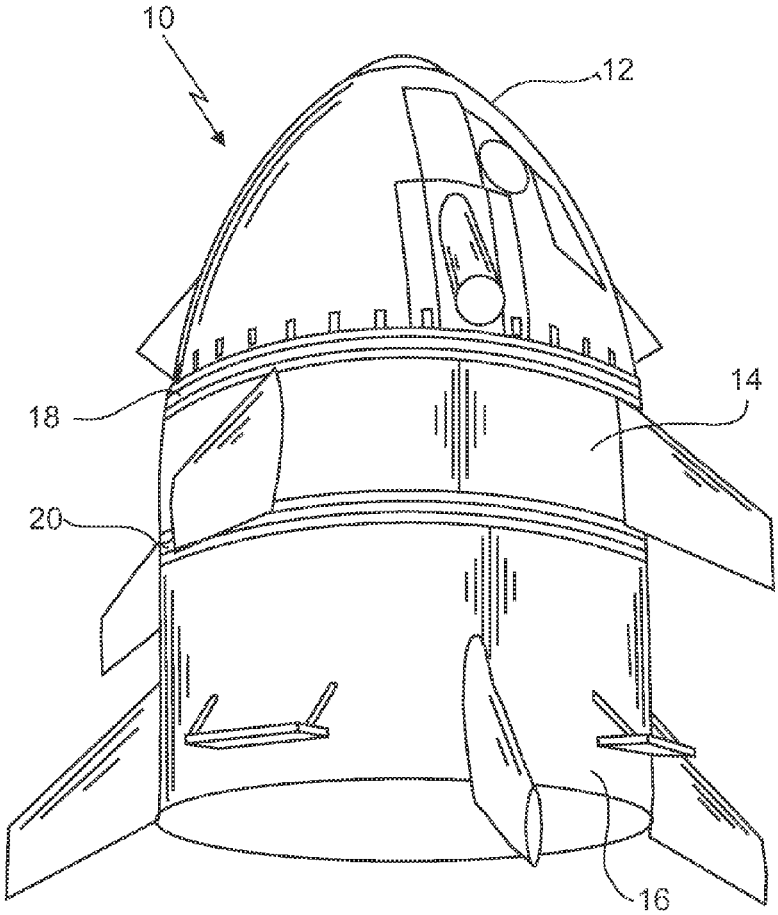
FIG. 1 is a perspective view of a rocket-type flight vehicle having embodiments of the present invention located therein.

Referring to FIG. 1, there illustrated is a perspective view of a rocket-type flight vehicle structure 10 having embodiments of the present invention located therein. However, it should be understood that embodiments of the present invention are not limited for use strictly with rocket-type flight vehicles. Many other types of flight vehicles, such as missiles, satellites, cargo hold and payload combinations and other similar type multi-stage flight vehicles may utilize embodiments of the present invention. A common feature of these various types of flight vehicles that utilize embodiments of the present invention is that the vehicles are comprised of two or more stages, and further that it is desired to separate at least one of the stages from the remaining portion of the flight vehicle at a particular point in time during flight and on command such that the separated stage falls away from the remaining portion of the flight vehicle, which then continues on its flight path.

The exemplary rocket 10 of FIG. 1 comprises three stages or structural portions: a front nose portion 12, an intermediary stage 14, and a rear lower stage 16. The nose portion 12 and the intermediary stage 14 may be connected together by a separation ring 18 having embodiments of the present invention located there within, as described in more detail hereinafter. Similarly, the intermediary stage 14 and the lower stage 16 may be connected together by a similar separation ring 20, also having embodiments of the present invention there within, as described in detail hereinafter. However, it is to be understood that embodiments of the present invention may be utilized with a flight vehicle 10 having more or less than three stages 12, 14, 16. Each separation ring 18, 20 is attached to the corresponding two adjacent flight vehicle stages 12, 14 and 14, 16, respectively, by, for example, bolts. Also, each separation ring contains a receiving channel having an explosive device (e.g., a mild detonating fuse) located there within that, when exploded, results in complete separation of the two stages previously held together by the particular separation ring 18, 20. One of the stages then falls off of the flight vehicle and the remainder of the flight vehicle continues on in its flight.

Figure 2:
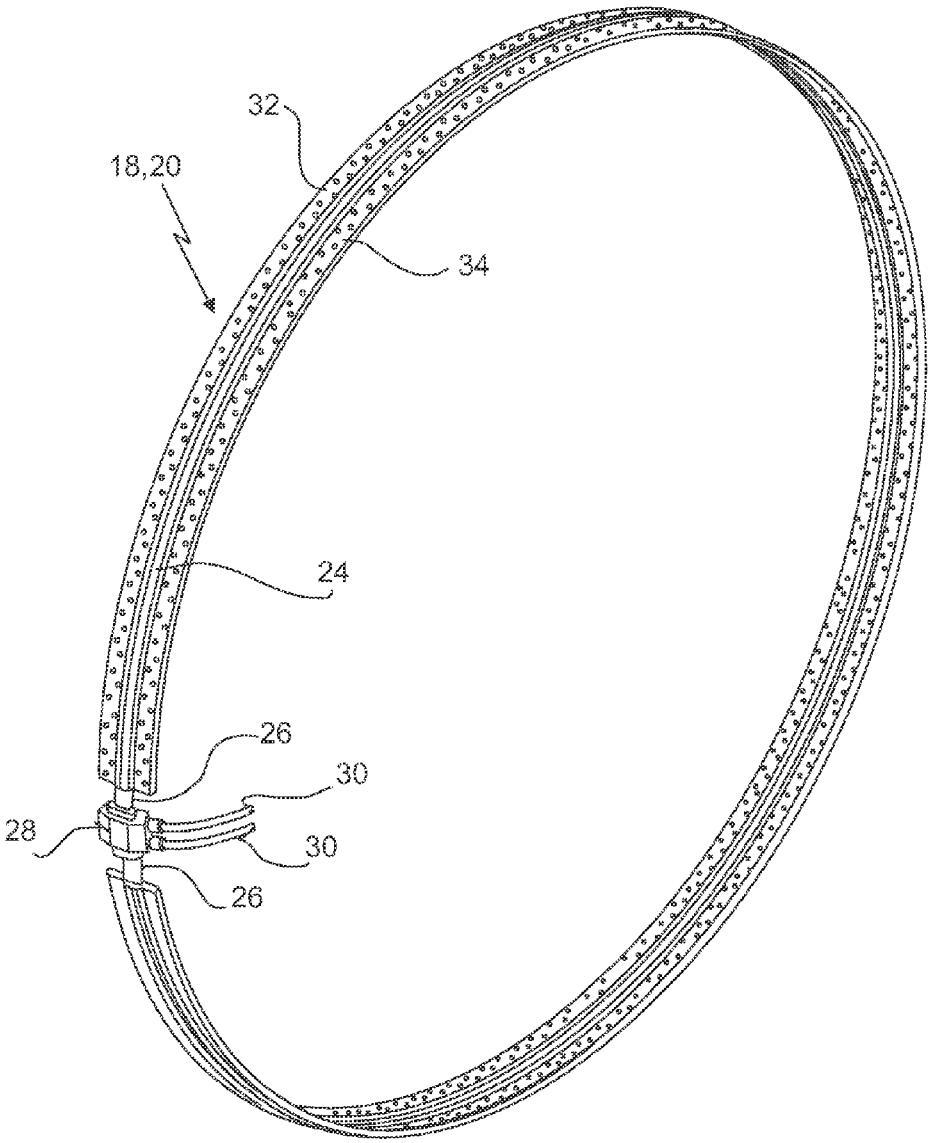
FIG. 2 is a perspective view of a separation ring utilized to connect together and then later explosively separate on command two stages of the rocket-type flight vehicle of FIG. 1.

Referring to FIG. 2, there illustrated is an embodiment of a frangible separation joint in the form of a separation ring 18, 20 utilized in the rocket embodiment of FIG. 1, and in many other embodiments of flight vehicle structures. As shown in FIG. 2, the ring 18, 20 is generally circular in shape to match the circular contour of the flight vehicle to which it attaches. The separation ring 18, 20 typically contains a centrally-located receiving channel 24 formed therein and having an expansion device or confinement tube 26 located within the channel 24, as described in more detail hereinafter. The confinement tube 26 may comprise a metal such as aluminum or stainless steel. Located within the confinement tube 26 is a linear explosive charge, as described in more detail herein after, such as a mild detonating fuse, that runs the entire length of the separation ring 18, 20. The opposite ends of the receiving channel 24, confinement tube 26, and the explosive charge are connected to an initiation or detonation manifold 28. The manifold 28 is in signal transfer communication with a pair of signal transfer wires 30 which connect the explosive charge with a device (not shown), such as a flight vehicle computer that initiates a signal on the wires 30 when it is time to detonate the explosive charge within the separation ring 18, 20, and, thus, to separate the two stages 12, 14, 16 of the flight vehicle 10 from one another.

The separation ring 18, 20 also includes a pair of flange-type joinder members 32, 34, one on each side of the centrally-located receiving channel 24. As shown in FIG. 2, each flange 32, 34 has a number of bolt holes that facilitate the attachment of the separation ring 18, 20 to the respective portion of each one of the two stages 12, 14, 16 (e.g., fairings) of the flight vehicle 10, as described in more detail hereinafter. As such, the receiving channel 24 is located in between the two stages or structure portions of the flight vehicle structure 10 (i.e., the rocket 10) and is also located between the two flanges 32, 34.

Figure 3:
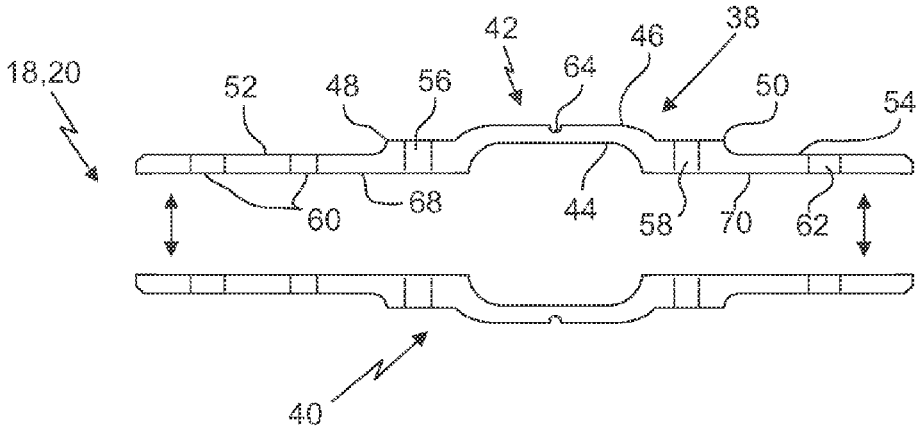
FIG. 3 is a cross-sectional view of an embodiment of a separation ring formed of a two-part flat form configuration and shown detached.

Referring to FIG. 3, there illustrated is a cross-sectional view of a separation ring 18, 20. More specifically, FIG. 3 illustrates an embodiment of a separation ring 18, 20 formed in a two-part flat form configuration, with the two parts shown detached. This type of two-part flat form separation configuration may be similar to that described and illustrated in U.S. Pat. No. 6,125,762, which is incorporated herein by reference.

FIG. 3 illustrates a pair of half-section members 38, 40 that comprise an embodiment of the separation ring 18, 20. The half-section members 38, 40 are identical in shape to one another and therefore symmetrical about a center line longitudinal axis when the two members 38, 40 are brought into facing contact with each other, as in FIG. 4. Because the half-section members 38, 40 are identical, only the features of the upper half-section member 38 shown in FIG. 3 are described in detail herein below with the understanding that the features of the lower half-section member 40 are identical to those of the upper half-section member shown in FIG. 3. The half-section member 38 is comprised of a longitudinally extending half-joint segment 42 having a concave interior side 44, and a convex exterior side 46. The half-joint segment 42 terminates in respective opposite lateral shoulders 48 and 50. From these lateral shoulders 48, 50 there extends in opposite facing directions a pair of half-flange segments 52 and 54. Each of the lateral shoulders 48, 50 has extending there through a respective fastener aperture 56 and 58. The half-flange segment 52 has extending there through a staggered array of first joinder flange apertures 60, while the half-flange segment 54 has extending there through second joinder flange apertures 62. In the illustrated embodiment, the second joinder flange apertures 62 are not staggered, but are presented in single file array. A rupture groove or seam 64 extends longitudinally along the exterior surfaces 46 of the half-joint segment 42.

Figure 4:
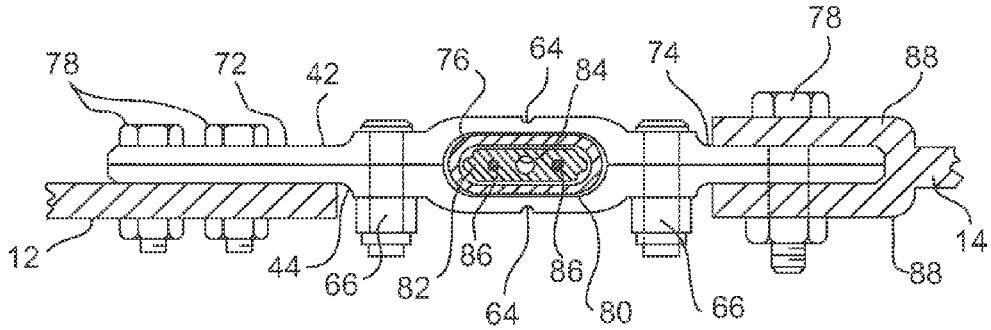
FIG. 4 is a cross-sectional view of the embodiment of the separation ring of FIG. 3 and shown connected.

Referring also to FIG. 4, the half-section members 38, 40 are secured to each other by a plurality of fasteners 66, with the half-flange segments 52, 54 having their respective interior joining surfaces 68 and 70 in face-to-face abutting contact with each other, whereby two sets of half-flange segments 52, 54 are joined to define a pair of mounting flanges 72, 74. The two half-section members 38, 40 may be joined by any suitable means other than by fasteners, such as welding, brazing or riveting, or by use of any other suitable mechanical fastening means.

Prior to such fastening of the half-section members 38, 40 to each other, an expansion device 76 is positioned between the concave interior sides 44 of the half-joint segments 42 so that the expansion device 76 is enclosed within a receiving channel (unnumbered) formed by the two half-joint segments 42 of the joined-together half-section members 38, 40. That is, the receiving channel is that space between the two concave sides 44 of the half-section members 38, 40 when those members 38, 40 are fastened together. The half-flange segments 52, 54 are each dimensioned and configured to provide solid mounting flanges 72, 74, without openings or passageways formed thereon, except for mounting holes or apertures which are formed transversely of the half-flange segments and are to be occupied by mechanical fasteners such as the bolts 78 shown in FIG. 4 and described below. Similarly, aside from the receiving channel formed within the frangible separation joint 18, 20 by facing concave interior sides 44 to receive the expansion device 76, the frangible joint in the form of the separation ring 18, 20 is solid throughout except for transversely-positioned fastener apertures 56, 58 which are to be occupied by the fasteners 66. It is thus seen that except for the apertures to be occupied by the mechanical fasteners and the channel which is occupied by the expansion device 76, the flat-form separation device 18, 20 is of solid construction and is free of interior chambers, openings, channels or the like. This solid construction enhances the strength of the flat-form separation device 18, 20, increasing its strength as compared to other devices of the same dimensions, or permitting the use of a separation device of given dimensions which is as strong or stronger than larger or thicker known devices.

The two joined half-joint segments 42 of FIG. 4 with grooves 64 thereon comprise the frangible joint 18, 20. The expansion device 76 comprises a containment or confinement tube 80 made of a metal, typically aluminum or stainless steel. In the embodiment shown in FIG. 4, the tube 80 is of an oval "racetrack" configuration. Within the tube 80 is a charger holder 82, typically made of silicone rubber or some other suitable elastomeric material, which has a hole formed throughout the length of the charge holder and which hole retains in place a linear explosive charge 84 that may comprise, for example, a mild detonating fuse. Note that the rupture grooves 64 are positioned on opposite sides of the mild detonating fuse and are co-extensive therewith.

In accordance with embodiments of the present invention, the elastomeric charge holder 82 also contains two metal wires 86 that are disposed within the charge holder 82 on either side of the mild detonating fuse 84. The wires 86 also run the length of the elastomeric charge holder and provide numerous advantages to the charge holder 82 specifically and to the frangible separation ring joint 18, 20, as compared to prior art devices, as discussed herein. The wires 86 may comprise stainless steel, although other metal material may be utilized for the wires 86. In various embodiments, the wires 86 may be solid, or the wires 86 may be tubular (i.e., have a hollow center portion). In various embodiments, the diameter of the wires 86 may be one-sixteenth of an inch, although that is purely exemplary.

Also, in embodiments of the present invention, the elastomeric charge holder material (e.g., silicone rubber) is over extruded or over molded onto each of the metal wires 86. Over extrusion of over molding of the elastomeric (e.g., silicone rubber) charge holder material onto the metal wire material results in improved or better thermal characteristics as well as improved retention requirements. The wire material is such that the silicone rubber charge holder material is retained in place and does not detach from the wire 86 throughout the spectrum of the required thermal and mechanical loads experienced during the various stages of vehicle flight. Also, the elastomeric charge holder and metal wire configuration of embodiments of the present invention allow for improved control of expansion and contraction throughout the various thermal environments that the flight vehicle is exposed to during flight.

FIG. 4 also shows a portion of a first stage 12 of the flight structure 10 (FIG. 1) and a portion of a second stage 14 of the flight structure 10, the stages 12, 14 being temporarily joined by the flat-form separation device 12. In an embodiment, the end of the bulkhead of the second stage 14 is of a clevis shape so that the mounting flange 74 formed by half-flange segments 54 fits within the legs 88 of the clevis-shaped second stage 14 and is secured thereto by a series of bolt fasteners 78, only one of which is visible in FIG. 4. Although normally the bulkheads of the support structures to be connected are identical and are of clevis shape as illustrated with respect to the second stage 14, the structure of the first stage 12 is shown, for purposes of illustration, as being of a different, single-wall design and is connected to one side of the mounting flange 72 formed by the half-flange segments 52 and is secured thereto by bolt fasteners 78. Accordingly, in an embodiment, at least one of the exterior flange surfaces of each mounting flange 72, 74 is dimensioned and configured to abut a surface of the first and second stages 12, 14.

Figure 5A:
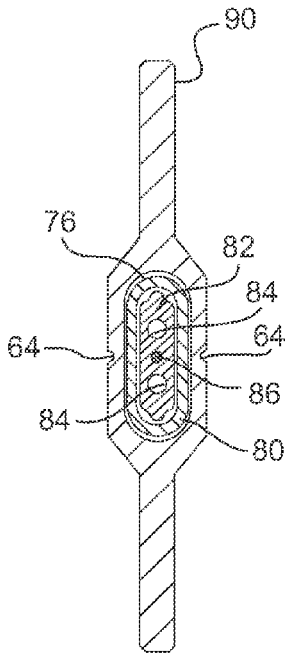
FIGS. 5A, 5B, and 5C, illustrate various embodiments of a portion of a frangible joint separation ring having a particular embodiment of an arrangement of a single wire disposed between two mild detonating fuses within the elastomeric charge holder.
Figure 5B:
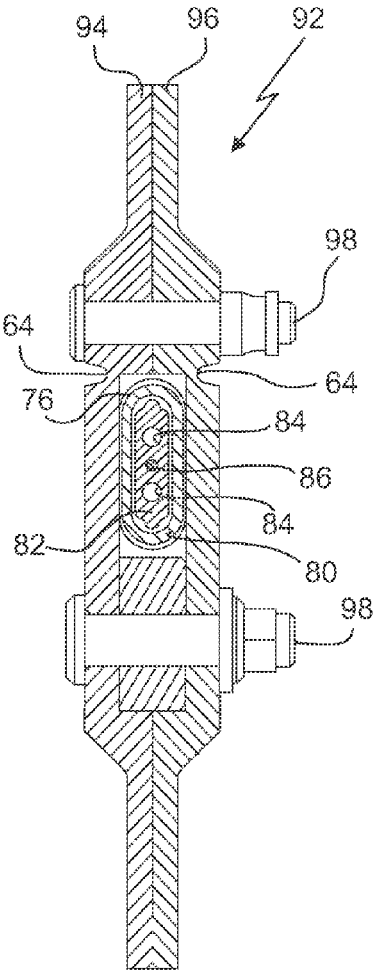
Figure 5C:
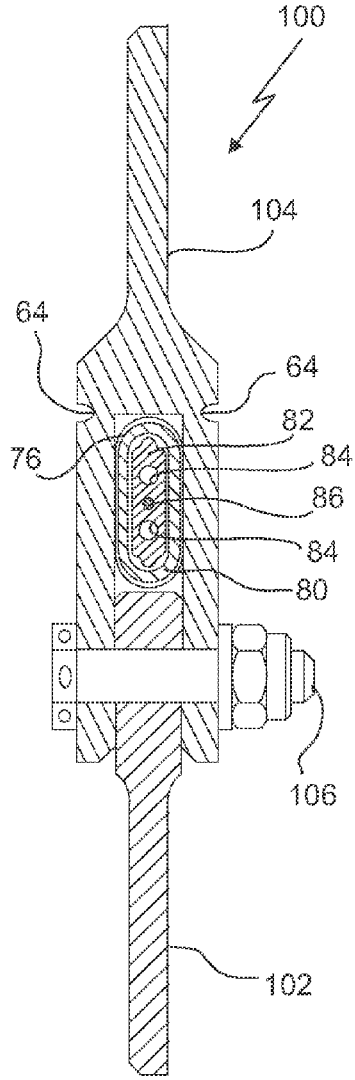

Referring to FIG. 5, including FIGS. 5A, 5B and 5C, there illustrated are various embodiments of a portion of a frangible joint separation ring 18, 20 having a particular embodiment of an arrangement of a single wire 86 disposed between two linear explosive charges (e.g., mild detonating fuses) 84 within the elastomeric charge holder 82. FIG. 5A illustrates a single-piece, hollow-form extrusion frangible joint 90. Except for the frangible joint 90 of FIG. 5A being of a single piece, other aspects of the embodiment of FIG. 5A are similar to that of FIG. 4, with the other exception of the number of and arrangement of the wires 86 and the mild detonating fuse 84. The fracture seam or notch 64 formed in the frangible joint 90 may be such that the frangible joint is referred to as a bending notch frangible joint.

FIG. 5B illustrates another embodiment of a frangible joint 92, this time comprising a shear notch frangible joint of the present invention. The frangible joint 92 comprises two plates 94, 96 held together by bolts 98. Otherwise, this embodiment is similar in other respects to that of FIG. 5A, including the number of and arrangement of the wires 86 and of the linear explosive charge 84. FIG. 5C illustrates yet another embodiment of a shear notch frangible joint 100 of the present invention. The frangible joint of this embodiment comprises a tang 102 and clevis 104 held together by a bolt 106. Again, otherwise, this embodiment is similar in other respects to that of FIG. 5A and FIG. 5B, including the number of and arrangement of the wires 86 and of the linear explosive charge 84.

Figure 6A:
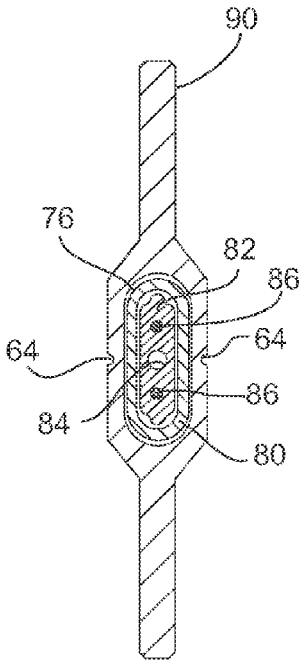
FIGS. 6A, 6B, and 6C, illustrate various embodiments of a portion of a frangible joint separation ring having a particular embodiment of an arrangement of a single mild detonating fuse disposed between a pair of wires within the elastomeric charge holder.
Figure 6B:
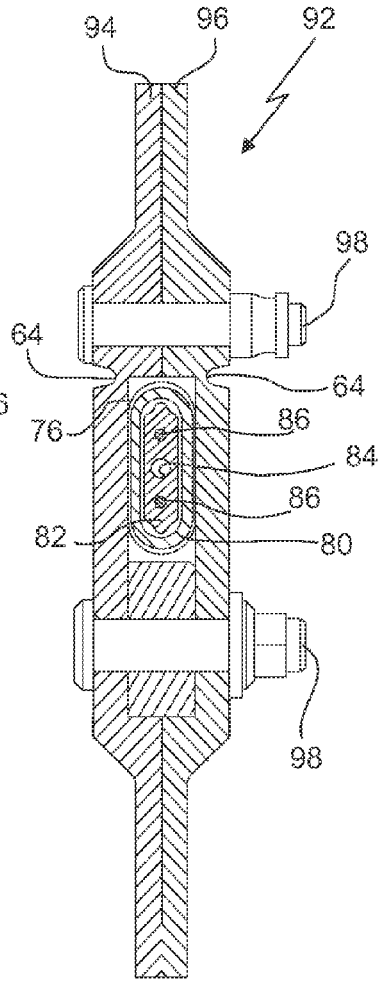
Figure 6C:
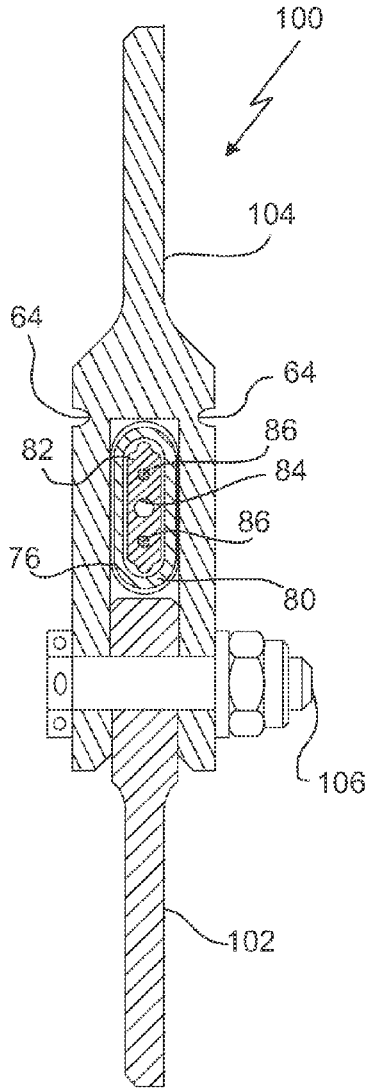

Referring to FIG. 6, including FIGS. 6A, 6B and 6C, there illustrated are other, various embodiments of a portion of a frangible joint separation ring 18, 20 having a particular embodiment of an arrangement of a pair of wires 86 disposed on either side of a linear explosive charge 84 within the elastomeric charge holder 82. This charge holder arrangement is similar to that of FIG. 4. FIG. 6A illustrates the single-piece, hollow-form extrusion frangible joint 90 similar to that of FIG. 5A. FIG. 6B illustrates the two-plate frangible joint 92 similar to that of FIG. 5B, and FIG. 6C illustrates the tang and clevis frangible joint 100 similar to that of FIG. 5C. In all three embodiments illustrated in FIGS. 6A, 6B and 6C, the charge holder 82 is such that there is an arrangement of a pair of wires 86 disposed on either side of a mild detonating fuse 84 within the elastomeric charge holder 82.

Figure 7A:
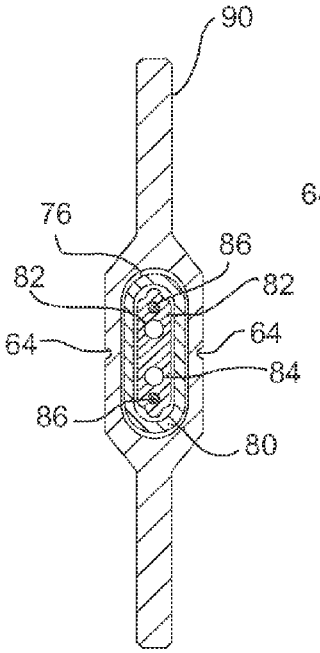
FIGS. 7A, 7B, and 7C, illustrate various embodiments of a portion of a frangible joint separation ring having a particular embodiment of an arrangement of a pair of wires and a pair of mild detonating fuses within the elastomeric charge holder.
Figure 7B:
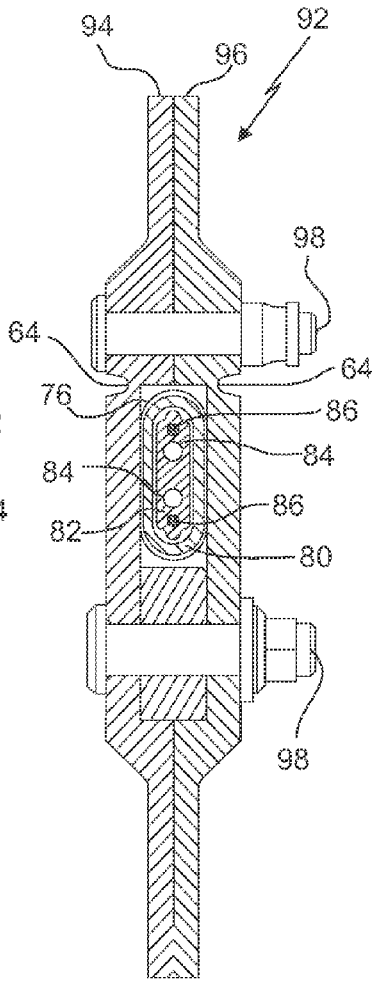
Figure 7C:
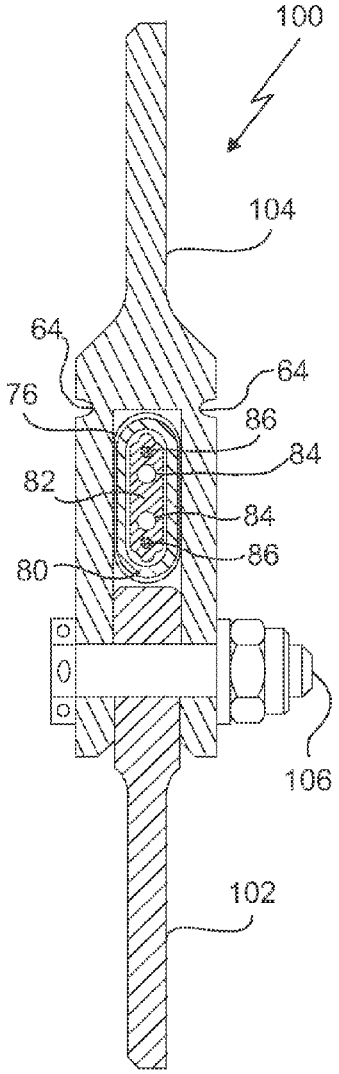

Referring to FIG. 7, including FIGS. 7A, 7B and 7C, there illustrated are yet other, various embodiments of a portion of a frangible joint separation ring 18, 20 having a particular embodiment of an arrangement of a pair of wires 86 and a pair of linear explosive charge 84. Each wire is disposed towards an outer periphery of the corresponding linear explosive charge 84 within the elastomeric charge holder 82. FIG. 7A illustrates the single-piece, hollow-form extrusion frangible joint 90 similar to that of FIGS. 5A and 6A. FIG. 7B illustrates the two-plate frangible joint 92 similar to that of FIGS. 5B and 6B, and FIG. 7C illustrates the tang and clevis frangible joint 100 similar to that of FIGS. 5C and 6C. In all three embodiments illustrated in FIGS. 7A, 7B and 7C, the charge holder 82 is such that there is an arrangement of a pair of wires 86 and a pair of linear explosive charges 84 in a particular arrangement within the elastomeric charge holder 82.

Figure 8A:
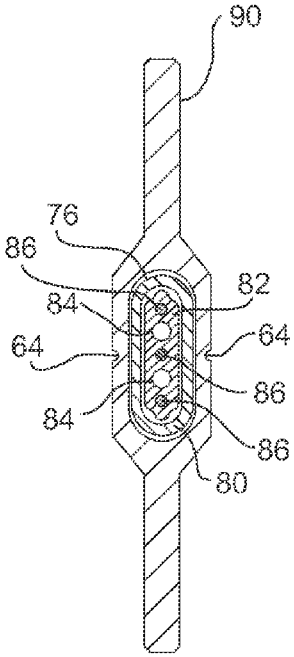
FIGS. 8A, 8B, and 8C, illustrate various embodiments of a portion of a frangible joint separation ring having a particular embodiment of an arrangement of a three wires and two mild detonating fuses disposed in an alternating arrangement within the elastomeric charge holder.
Figure 8B:
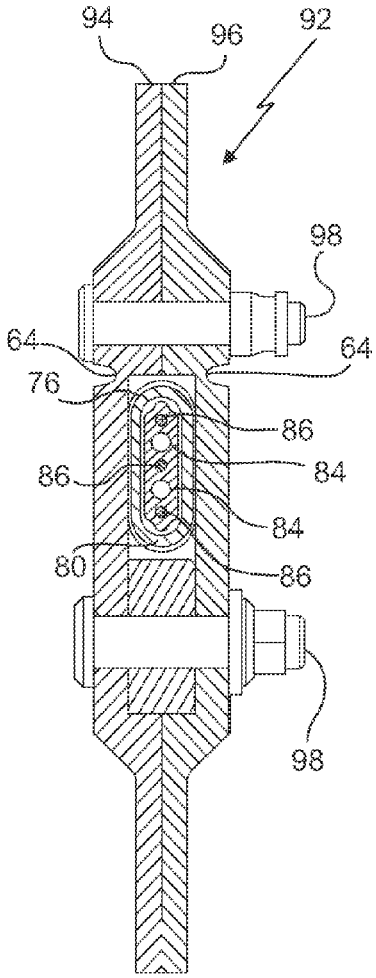
Figure 8C:
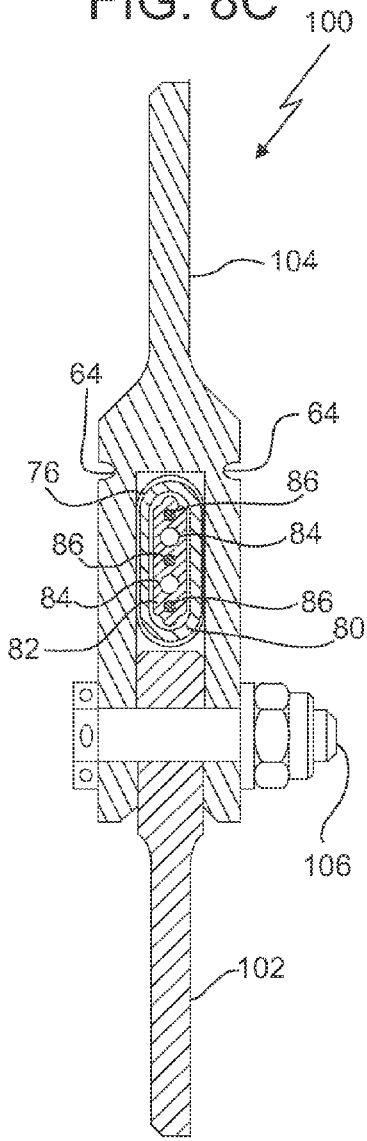

Referring to FIG. 8, including FIGS. 8A, 8B and 8C, there illustrated are still other, various embodiments of a portion of a frangible joint separation ring 18, 20 having a particular embodiment of an arrangement of three wires 86 and a pair of linear explosive charges 84. As seen in FIGS. 8A, 8B and 8B, the wires 86 and linear explosive charges 84 are disposed in an alternating arrangement within the charge holder. FIG. 8A illustrates the single-piece, hollow-form extrusion frangible joint 90 similar to that of FIGS. 5A, 6A and 7A. FIG. 8B illustrates the two-plate frangible joint 92 similar to that of FIGS. 5B, 6B and 7B, and FIG. 8C illustrates the tang and clevis frangible joint 100 similar to that of FIGS. 5C, 6C and 7C. In all three embodiments illustrated in FIGS. 8A, 8B and 8C, the charge holder 82 is such that there is an arrangement of three wires 86 and a pair of linear explosive charges 84 in a particular arrangement within the elastomeric charge holder 82.

Still other embodiments of a charge holder having at least one wire or wire tube disposed there within and also having at least one explosive charge also disposed there within are possible and contemplated by the present invention. That is, the various embodiments described and illustrated herein are purely exemplary.

Embodiments of the present invention provide advantages with respect to interface features of the one or more metal wires to achieve relatively improved mechanical retention of the silicone rubber charge holder as the assembly level, as well as relatively improved control of the elastomeric material through the various thermal environments that the elastomeric material is exposed to during flight, thereby better matching the elastomeric material to the metal wire material.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A frangible joint that connects together two portions of a structure, comprising:

a pair of joinder members that each connect with one of the two portions of the structure;

an elastomeric charge holder located in between the two portions of the structure;

at least one metallic wire located within the charge holder and running for at least most of a length of the charge holder; and at least one length of explosive material located within the charge holder and running for at least most of the length of the charge holder; wherein each metallic wire located within the charge holder is substantially parallel to and spaced apart from each length of explosive material located within the charge holder.

2. The frangible joint of claim 1, wherein the at least one wire comprises one of a solid wire or a wire tube.

3. The frangible joint of claim 1, further comprising a confinement tube surrounding the charge holder.

4. The frangible joint of claim 1, wherein the elastomeric material comprises silicone rubber.

5. The frangible joint of claim 1, wherein the charge holder is over extruded or over molded onto the at least one wire thereby retaining the wire in a fixed position.

6. The frangible joint of claim 1, wherein the frangible joint comprises at least two wires and a single length of explosive material, wherein the two wires are disposed on either side of the length of explosive material within the charge holder.

7. The frangible joint of claim 1, wherein the frangible joint comprises at least two wires and at least two lengths of explosive material, a first one of the two wires being disposed to one side of a first one of the two lengths of explosive material within the charge holder, a second one of the two wires being disposed to one side of a second one of the two lengths of explosive material holder.

8. The frangible joint of claim 1, wherein the frangible joint comprises at least three wires and at least two lengths of explosive material, wherein the three wires and the two lengths of explosive material are arranged in an alternating configuration within the charge holder.

9. The frangible joint of claim 1, wherein the frangible joint comprises a single wire and at least two lengths of explosive material, wherein the two lengths of explosive material are disposed on either side of the single wire within the charge holder.

10. The frangible joint of claim 1, wherein the structure comprises separate stages or panels of a fairing of one of a rocket, missile or satellite.

11. A frangible joint that connects together two portions of a structure through use of a pair of joinder members, each one of the pair of joinder member being connected with a corresponding one of the two portions of a structure, comprising:

a confinement tube;

a charge holder disposed within the confinement tube;

at least one metallic wire located within and coupled to the charge holder and running for at least most of a length of the charge holder; and at least one length of explosive material located within the charge holder and running for at least most of the length of the charge holder; wherein each metallic wire located within the charge holder is parallel to and spaced apart from each length of explosive material located within the charge holder.

12. The frangible joint of claim 11, wherein the charge holder is over extruded or over molded onto the at least one wire thereby retaining the wire in a fixed position.

13. The frangible joint of claim 11, wherein the charge holder comprises an elastomeric material.

14. The frangible joint of claim 13, wherein the elastomeric material comprises silicone rubber.

15. The frangible joint of claim 11, wherein the frangible joint comprises at least two wires and a single length of explosive material, wherein the two wires are disposed on either side of the length of explosive material within the charge holder.

16. The frangible joint of claim 11, wherein the frangible joint comprises at least two wires and at least two lengths of explosive material, a first one of the two wires being disposed to one side of a first one of the two lengths of explosive material within the charge holder, a second one of the two wires being disposed to one side of a second one of the two lengths of explosive material holder.

17. The frangible joint of claim 11, wherein the frangible joint comprises at least three wires and at least two lengths of explosive material, wherein the three wires and the two lengths of explosive material are arranged in an alternating configuration within the charge holder.

18. The frangible joint of claim 11, wherein the frangible joint comprises a single wire and at least two lengths of explosive material, wherein the two lengths of explosive material are disposed on either side of the single wire within the charge holder.

* * * * *